US005964288A

United States Patent [19]

Leighton et al.

[11] Patent Number: 5,964,288

[45] Date of Patent: Oct. 12, 1999

[54] DEVICE AND PROCESS FOR THE LINING OF A PIPE BRANCH, PARTICUARLY IN AN OIL WELL

[75] Inventors: James Leighton, L'Hermitage; Jean-Louis Saltel, Le Rheu, both of France

[73] Assignee: Drillflex, France

[21] Appl. No.: 09/011,414

[22] PCT Filed: Aug. 2, 1996

[86] PCT No.: PCT/FR96/01225

§ 371 Date: Jul. 20, 1998

§ 102(e) Date: Jul. 20, 1998

[87] PCT Pub. No.: WO97/06345

PCT Pub. Date: Feb. 20, 1997

[30] Foreign Application Priority Data

Aug. 4, 1995 [FR] France ..... 95 09695

[51] Int. Cl.[6] ..... E21B 43/10

[52] U.S. Cl. ..... 166/207; 405/150.1

[58] Field of Search ..... 166/380, 381, 166/50, 206, 207, 222, 223, 242.2; 299/19; 405/150.1, 154, 146; 156/287, 294; 138/97

[56] References Cited

U.S. PATENT DOCUMENTS 2,804,926 9/1957 Zublin ..... 166/50
4,444,276 4/1984 Peterson, Jr. ..... 175/61
5,388,648 2/1995 Jordan, Jr. ..... 166/380

FOREIGN PATENT DOCUMENTS

94/03698 2/1994 WIPO .
94/21887 9/1994 WIPO .
94/25655 11/1994 WIPO .

*Primary Examiner*—David Bagnell
*Assistant Examiner*—Sunil Singh
*Attorney, Agent, or Firm*—Blakely Sokoloff Taylor & Zafman

[57] ABSTRACT

The device includes a radially deformable flexible tubular preform (1) that can be expanded by internal pressure and hardened in situ by heating its wall to polymerize it, the preform is formed of a rectilinear main section (10 and a rectilinear secondary section (11) at an acute angle ($\alpha$) to the main section (10) and joined and sealed to the latter in a middle area **(10*c*), temporary restraining bindings being provided to hold the secondary section initially in a radially folded condition, pressed against the main section (10), the combination then constituting a rectilinear preform, whereas after removal of the temporary restraining bindings (3), and due to internal pressure, the secondary section (11) separates from the main section (10)**, the combination then constituting a generally "y" shape preform adapted to be polymerized in the area of bifurcation of the well.

7 Claims, 7 Drawing Sheets

1
2
3
10
10a
10b
10c
11
20
110
A
B
La
Lb
L
C
α

DEVICE AND PROCESS FOR THE LINING OF A PIPE BRANCH, PARTICUARLY IN AN OIL WELL

BACKGROUND OF THE INVENTION

1. Field of the Invention

The present invention concerns a device and a process for lining a bifurcation in a well, particularly in an oil well.

2. Description of Related Art

The invention finds a particular application in sealing and lining the area where a main bore that is generally (although not necessarily) vertical joins an oblique bore running from the vertical bore, known in the art as a "side track".

This type of secondary bore is used to access lateral oil-bearing reservoirs when the main reservoir is exhausted or has become uneconomic or simply to increase the productivity of the well.

This type of bore also enables the production area to be significantly expanded into areas where access is difficult without having to drill a new well from the surface; this applies in particular to production from deposits under the sea.

Prior art processes use metal tubes to consolidate and seal the borehole, both for the main well and often for the secondary wells, and it is difficult to obtain a good seal in the area of the join.

It has already been proposed to line a well by means of an initially flexible radially deformable tubular preform that can be expanded by internal pressure and hardened in situ by heating its wall to polymerize it.

This technique is described in documents WO-94/21887 and WO-94/25655 and in unpublished French patent application 94 08691 of Jul. 7 1994, for example.

The present invention proposes to transpose this technique known in itself to lining the bifurcation area in which the main bore and the secondary bore join.

BRIEF SUMMARY OF THE INVENTION

The objective of the invention is to propose a simple low-cost lightweight device that is easy to put into place and produces a perfect seal of the junction in the bifurcation area.

The device for lining a bifurcation in a well, in particular in an oil well, in accordance with the present invention comprises—in a manner that is known in itself—a radially deformable flexible tubular preform that can be expanded by internal pressure and hardened in situ by heating its wall to polymerize it. The device is remarkable in that said preform is formed of a rectilinear main section and a rectilinear secondary section at an acute angle to the main section and joined and sealed to the latter in a middle area, temporary restraining means being provided to hold the secondary section initially in a radially folded condition, pressed against the main section, the combination then constituting a rectilinear preform, whereas after removal of said temporary restraining means, and due to internal pressure, the secondary section separates from the main section, the combination then constituting a generally "y" shape preform (the bottom bar of which is aligned with one of the top bars).

In accordance with a number of further, non-limiting features of the invention:

the device includes an expander tool in the form of an inflatable flexible and elastic membrane bag housed inside the preform and adapted to be pulled out at the end of operation.

in the expanded state each section has a circular cross-section, the diameter of the main section being greater than or the same as that of the secondary section.

said restraining means are breakable annular bindings around the main and secondary sections adapted to break one after the other beyond a particular internal pressure threshold.

The process for lining and sealing a bifurcation in a well, in particular in an oil well, comprising a main bore and an oblique secondary bore by means of a device as described hereinabove is remarkable in that, using a preform in which the angle between said main section and said secondary section is close to that of the bifurcation:

a) the preform is lowered into the well when in the radially retracted state and with the secondary section pressed against the main section, the combination having a rectilinear configuration;

b) the preform is positioned in the area of the bifurcation so that the free end of the secondary section is at the entry of the oblique secondary bore;

c) the preform is inflated at moderate pressure (pre-inflation) so as to rupture progressively the restraining bindings and to cause progressive radial unfolding and angular deployment of the secondary section concomitantly with further lowering of the preform;

d) lowering is stopped when the bifurcate portion of the preform is substantially positioned at the level of the bifurcate portion of the well;

e) the preform is inflated by increasing its internal pressure to cause it to expand radially and to press it against the walls of the well;

f) with the pressure maintained, the preform is heated to polymerize the wall;

g) the bag is deflated and separated from the preform.

Other features and advantages of the invention will become apparent from the description and the appended drawings which show by way of non-limiting example one embodiment and one preferred use of the invention.

DETAILED DESCRIPTION OF THE INVENTION

Figures 1, 2, 3, 4, 5A, 5B, 5C:
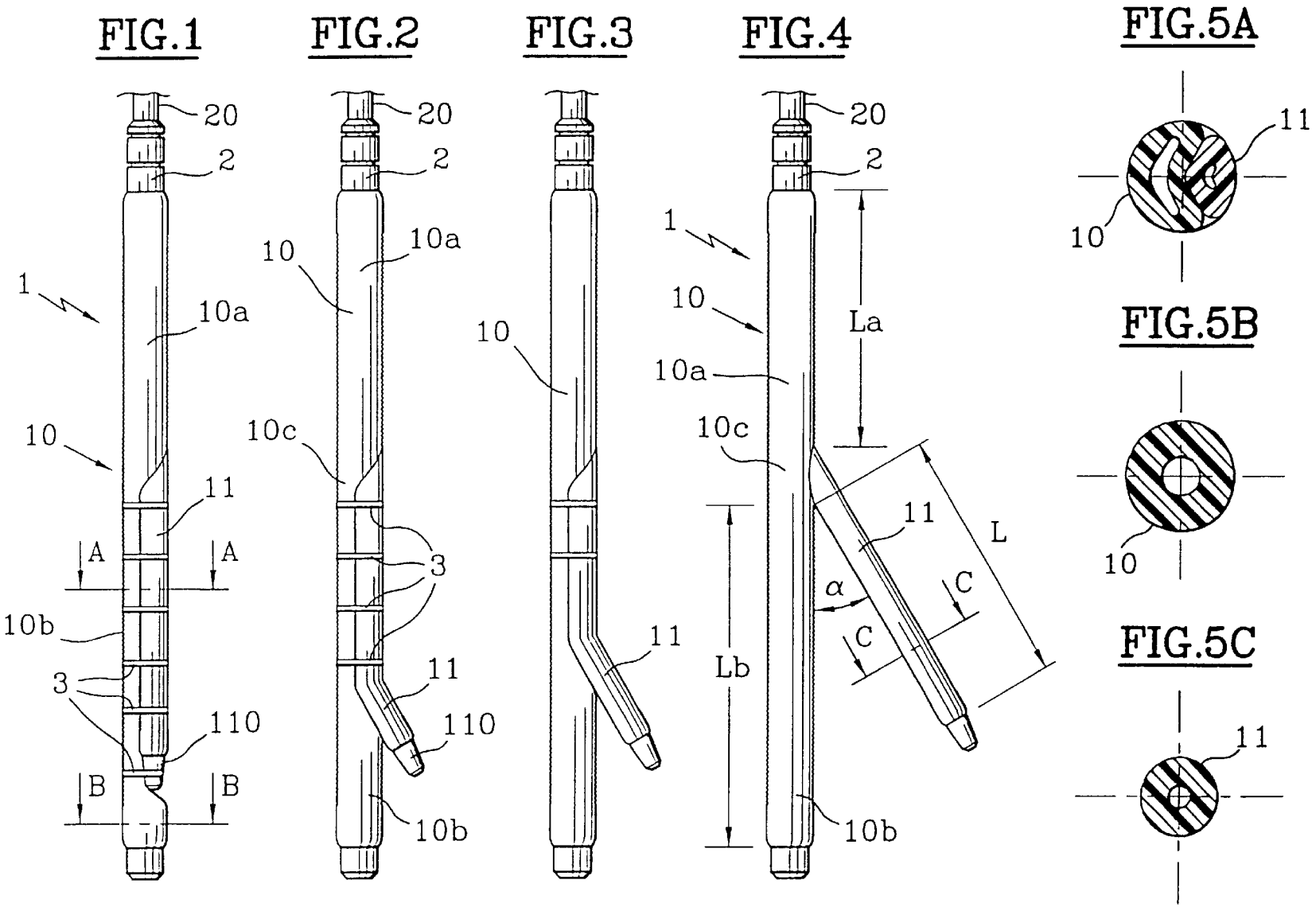
FIG. 1 is a general view of the preform in its initial state, before it is introduced into the well.
FIGS. 2, 3 and 4 are views similar to FIG. 1 showing a plurality of successive steps of deployment of the preform during putting it into place.
FIGS. 5A, 5B, 5C are sections of the preform taken along the respective lines A—A in FIG. 1, B—B in FIG. 1 and C—C in FIG. 4.

In its normal state, which is that shown in FIG. 4, the preform 1 that constitutes the essential part of the device of the invention is a flexible preform that can be folded on itself longitudinally to occupy a small overall radial size and can first be made round by a moderate internal pressure and then expended radially by a higher internal pressure.

Figure 6:
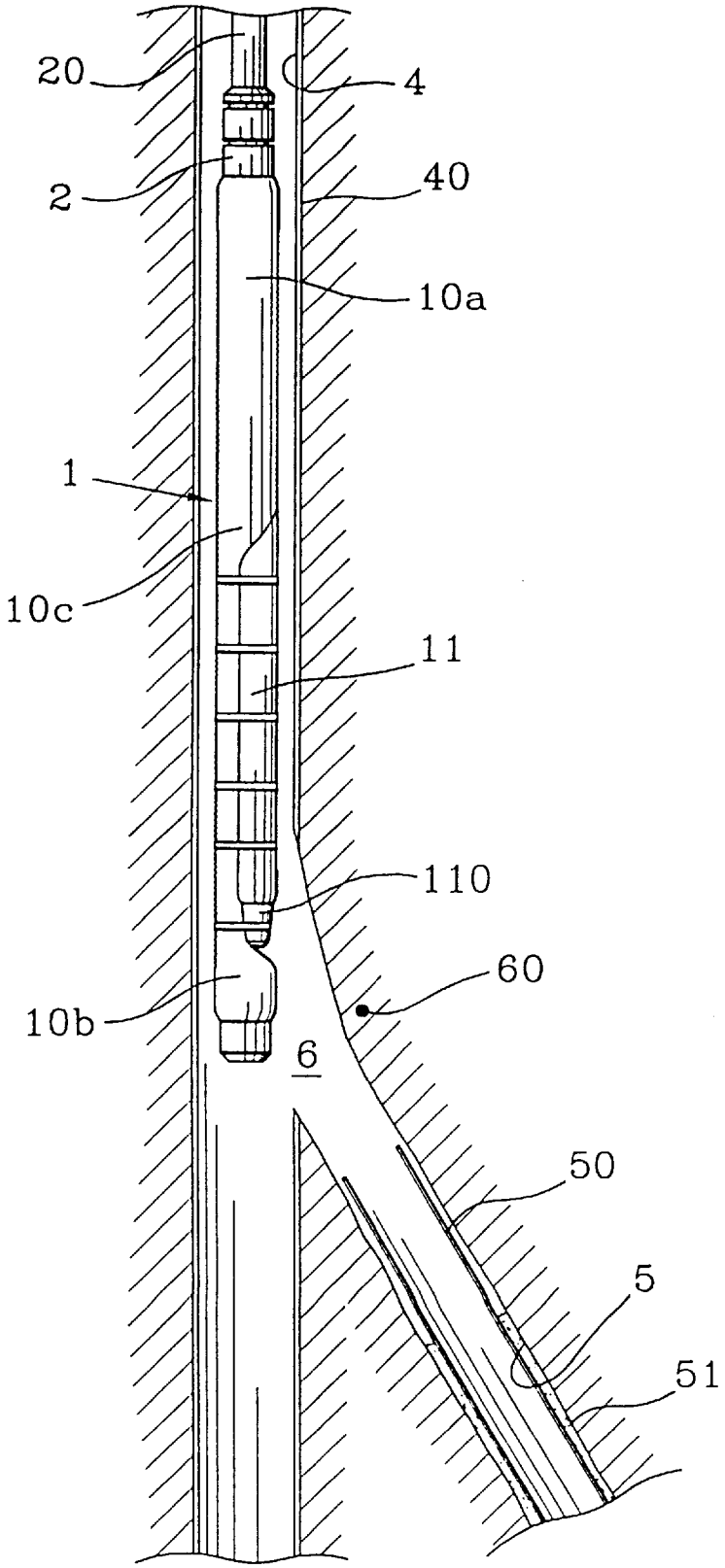
FIG. 6 is a schematic general view showing in longitudinal section a bifurcation in a well into which a preform for lining said bifurcation has been introduced.
Figure 7:
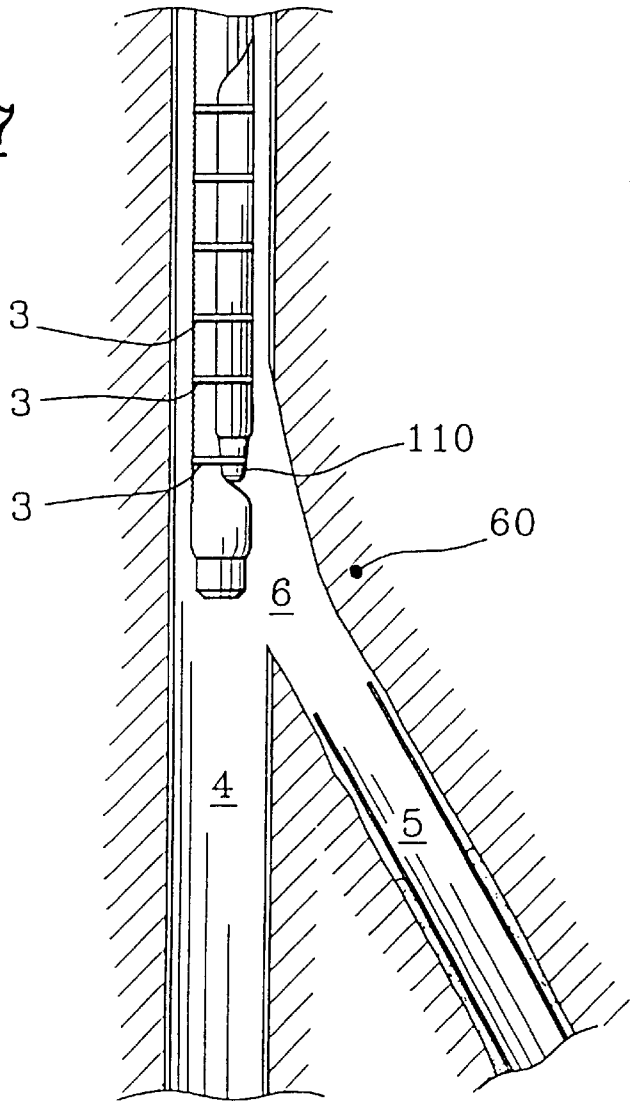

This principle of two-stage expansion, i.e. unfolding followed by expansion, is described in WO-94/25655 already cited, for example (see FIGS. 6A or 6B, 7 and 7').

In accordance with the present invention, the preform 1 includes a rectilinear main section 10 and a secondary section 11 at an acute angle to the main section and joined to the latter in its middle area.

The preform is therefore the general shape of an inverted "y" with the bifurcation directed downwards, i.e. towards the bottom of the well.

The branch 10*a* of the main section is towards the mouth of the well and the other branch 10*b* faces towards the bottom of the well, this branch facing the secondary section 11.

The branches 10*a* and 10*b* have respective lengths La and Lb between 3 m and 5 m and the secondary section 11 has a length L in the order of 2 m to 4 m.

In the unfolded state the tubular sections 10 and 11 are cylindrical in shape, for example, the main section 10 has an outside diameter in the order of 100 mm and an inside diameter in the order of 50 mm and the section 11 has an outside diameter in the range 80 mm to 100 mm and an inside diameter in the range 30 mm to 50 mm.

The diameters are of course related directly to the diameters of the tubing in the well.

The angle $\alpha$ is in the order of 30°, for example.

The preform 1 and the internal expander tool, which is described in more detail below, are fixed at the upper end of the preform to a tool 2 fastened to the end of a cable, flexible tube or appropriate tooling 20, the opposite end of which exits the well through the well head.

Apparatus at the well head lowers the tube 20 into the well to bring the preform into the required position, the cable, tube or tooling and the tool 2 being removed at the end of the operation, as is well known in the art.

The tubular preform 1 has a multilayer structure that generally includes an outer skin and an inner skin between which is confined a resin that can be hardened by heat and is initially flexible and malleable.

With no internal pressure the part 10 can be folded longitudinally to a generally heart-shaped section, as shown in FIG. 5A.

This shaping provides a place for the section 11 which, also by being deformed, can be pressed intimately against the section 10*b* so that the two sections in contact are inscribed within an imaginary cylinder extending the section 10*a* axially (see FIGS. 1 and 5A).

The preform is held in its folded condition and compressed by means of a series of regularly spaced annular restraining bindings 3. These are glassfiber cables, for example.

The bindings have a tensile strength that increases progressively from the bottom upwards, for example, the bottom binding breaking more easily than the binding above it, and so on, up to the top binding, which is near the area 10*c* where the section 11 joins the main section.

FIG. 6 shows the bifurcate well to be tubed in section. It comprises a main bore 4, often vertical, fitted with cylindrical metal tubing 40, and an oblique bore 5 also provided with metal tubing 50, surrounded by cement 51.

The area 6 where the two bores join is surrounded by soil 60 and it is here that the sealing problem arises, given that the tubing 40 and the tubing 50 are not joined together.

The device of the invention includes, mounted inside the preform 1, an expanded tool in the form of an inflatable bag with a flexible and elastic membrane into the interior of which it is possible to introduce a fluid under pressure, either from the well head or by pumping the liquid present in the well—for example water or oil—the pressure of which can be varied and monitored.

This type of preform/expander tool combination is already described in detail in the previously mentioned WO-94/25655, to which reference may be had as required, and for this reason will not be described again here in detail, as this would burden the description unnecessarily.

Figure 11:
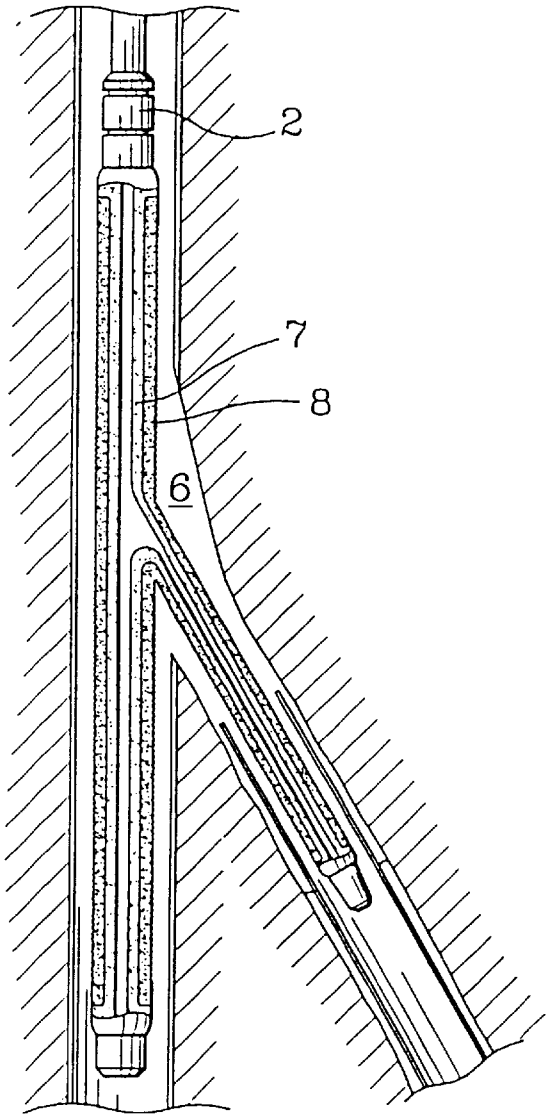

Referring to FIG. 11, the bag is constituted by the membrane 7 into which the tool 2 opens and which is closed off at its bottom end. The bag has the shape of an inverted "y", complementary to its housing inside the preform.

The preform has a wall 8 of material that can be hardened by heating it.

Referring again to FIG. 6, which shows the start of the lining operation, note that the preform 1 suspended from the tool 2 and from the cable, tube or tooling 20 has been lowered into the well so that the "closed" free end 110 of the secondary section 11 is in the bifurcation area 6, substantially at the mouth of the secondary bore 5.

The preform moves easily in the well because it has a rectilinear configuration and a small overall size in the radial direction.

This position is shown in FIG. 7.

By introducing a fluid at moderate pressure, not exceeding a particular limiting value, into the interior of the bag/preform combination, an initial pre-inflation of the preform is achieved, the effect of which is first to break the lowest binding 3 (the weakest one).

At the same time, the preform is lowered a little further into the well.

Figure 8:
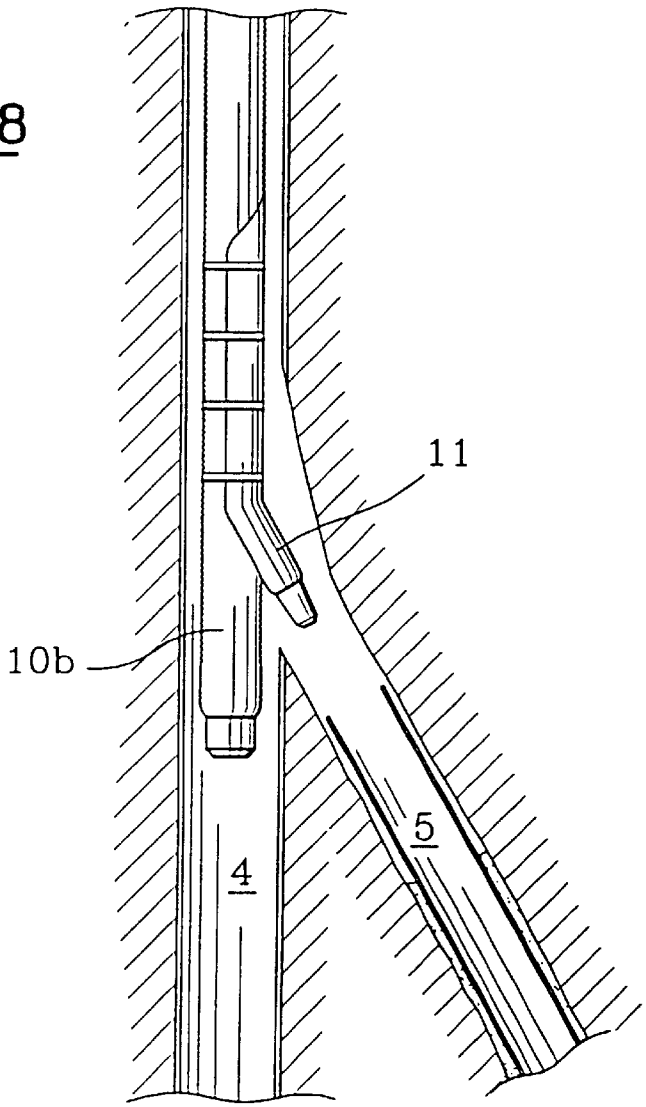
FIGS. 7 through 16 are viewed analogous to FIG. 6, to a larger scale, showing the various steps of the lining process, the preform being shown in longitudinal section in FIGS. 11 through 16.

By virtue of the first binding breaking, the bottom end areas of the section 10*b* and the section 11 assume a cylindrical shape and the part 11 tends to separate from the part 10*b*, being deployed laterally, to take up an angle to the part 10*b*. This movement, associated with other orientation means, enables it to orient itself substantially on the axis of the secondary bore 5 (see FIG. 8).

Figure 9:
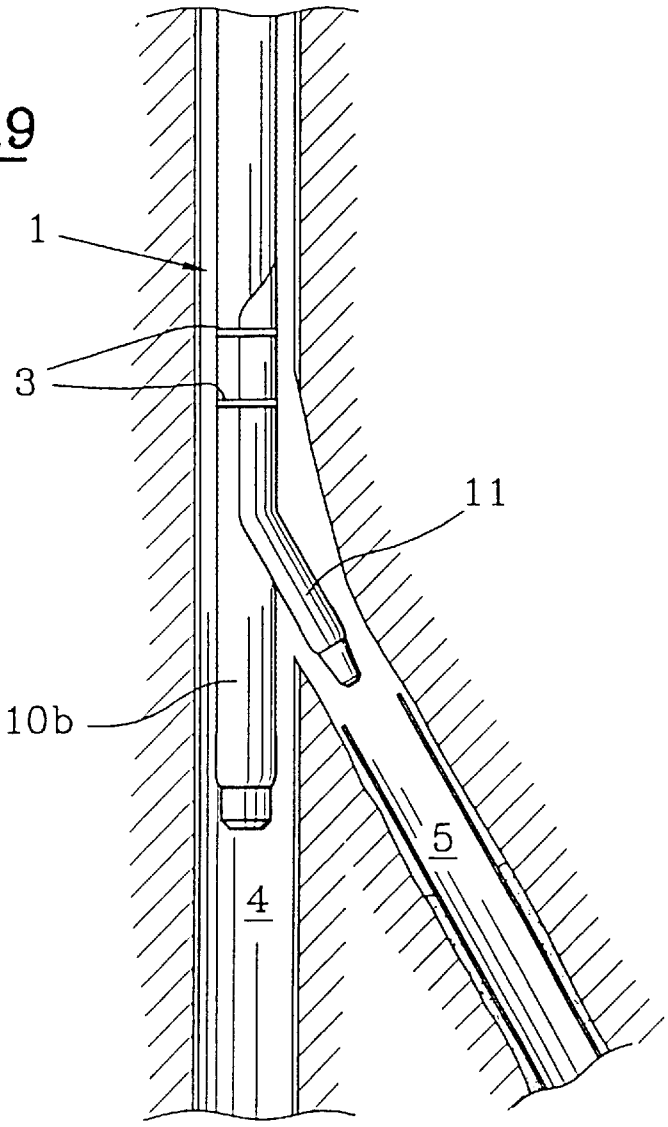

The bindings 3 break in succession, from the bottom upwards, concomitantly with the lowering of the preform 1, the branch 10*b* descending vertically and coaxially in the main bore 4 and the section 11 penetrating axially into the secondary bore 5 (see FIG. 9).

Figure 10:
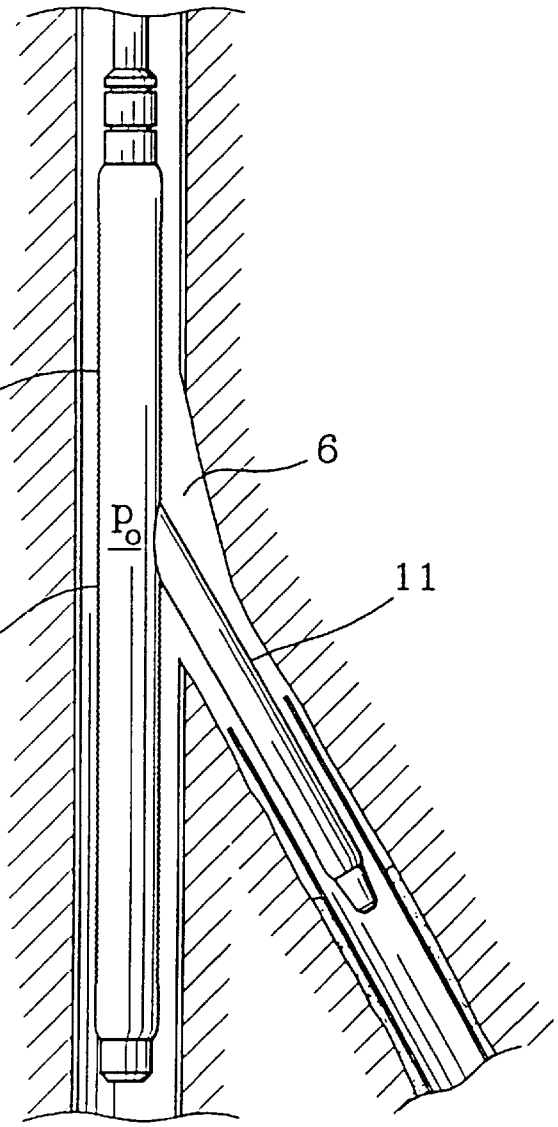

When—as shown in FIG. 10—the middle area of the preform 10*c* reaches the bifurcation area 6, the main section 10 and the secondary section 11 of the preform being substantially aligned with the main bore 4 and the secondary bore 5, respectively, lowering of the preform is stopped. In this state, the preform is still at a moderate pressure $P_0$(FIG. 10).

The same situation is shown in FIG. 11, which shows the expandable bag/preform combination in section.

The fluid pressure inside the bag 7 is then increased to a value P significantly greater than $P_0$.

Figure 12:
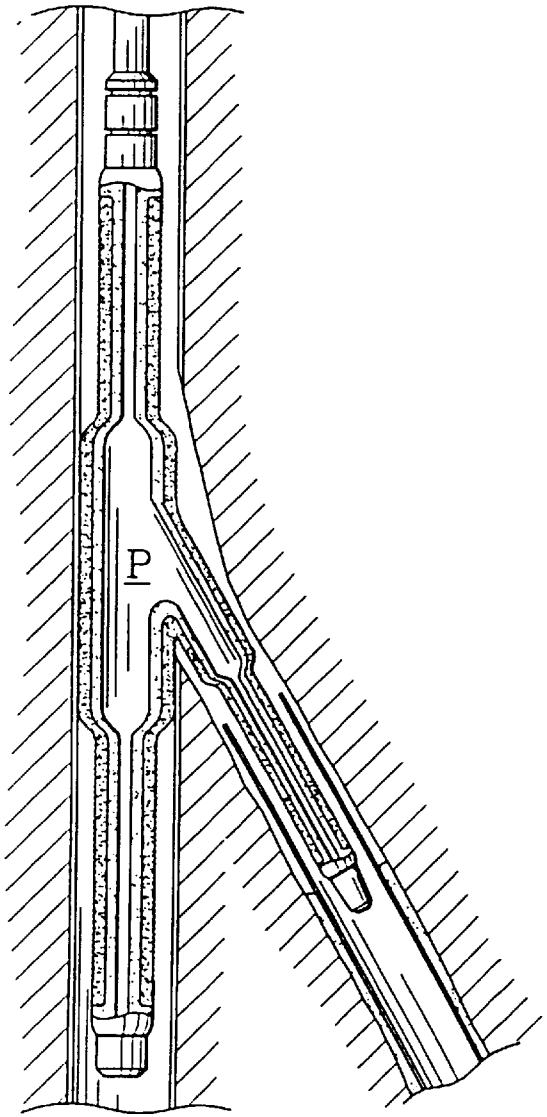
Figure 14:
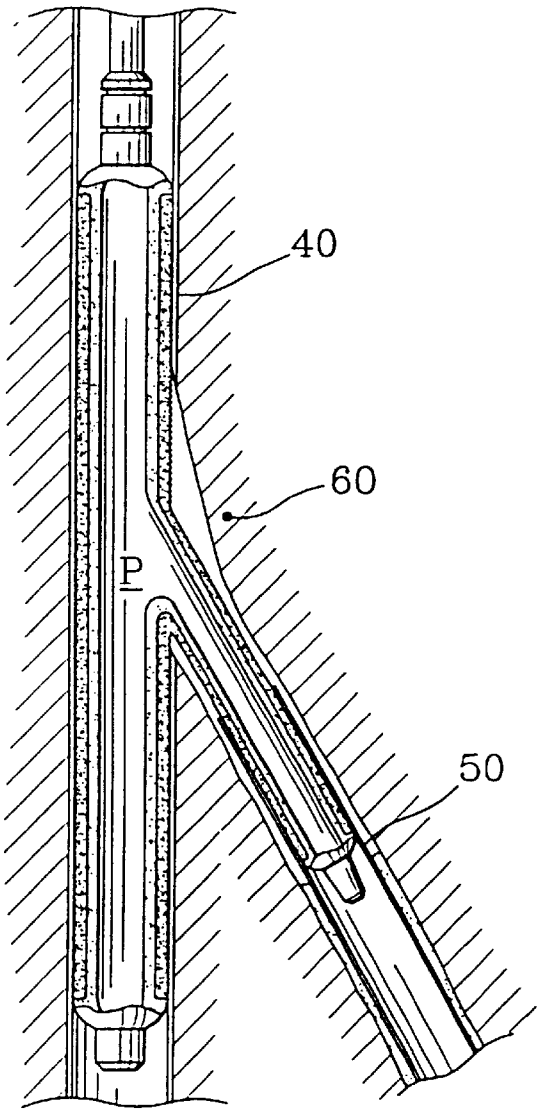
Figure 13:
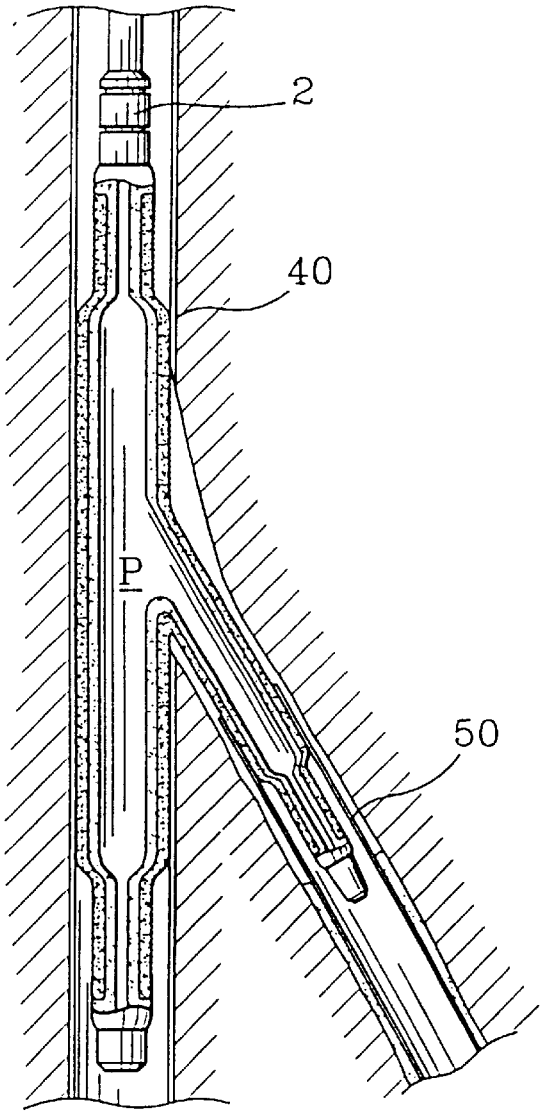

This causes inflation and progressive radial expansion from its middle area of the whole of the preform, as shown in FIGS. 12, 13 and 14.

At the end of inflation, the top and bottom ends of the main section of the preform are pressed intimately against the tubing 40; likewise, the free end area of the secondary section 11 is pressed intimately against the tubing 50.

The middle area of the preform is necessarily in contact with the wall 60, but this is of no importance.

Then, in the conventional manner as described in WO-94/25655 already cited, for example, the preform is heated to polymerize it. This can be done by introducing a hot liquid into the interior of the preform, for example, or by chemical reaction or by the Joule effect, electrically conductive wires being embedded in the wall of the preform and/or the membrane of the expander tool.

After polymerization, the preform is rigid and the required tubing is obtained in the form of an inverted "y" shape pipe that is perfectly sealed and connects the tubing 40 and the tubing 50.

Figure 15:
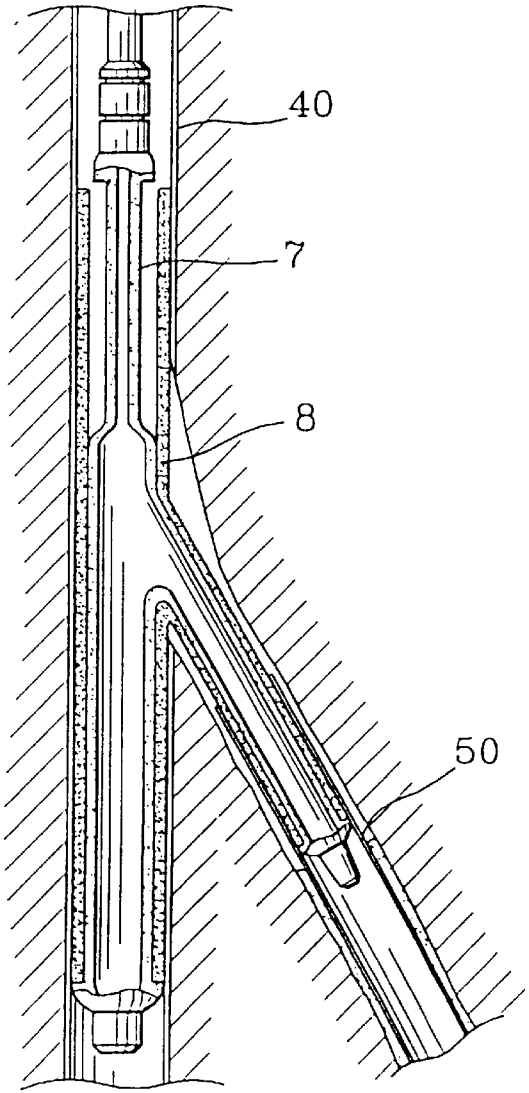

As shown in FIG. 15, the bag 7 is then deflated by pumping out the liquid in it and then said bag is pulled out by pulling out the tool 2 and the deflated bag attached to it.

Figure 16:
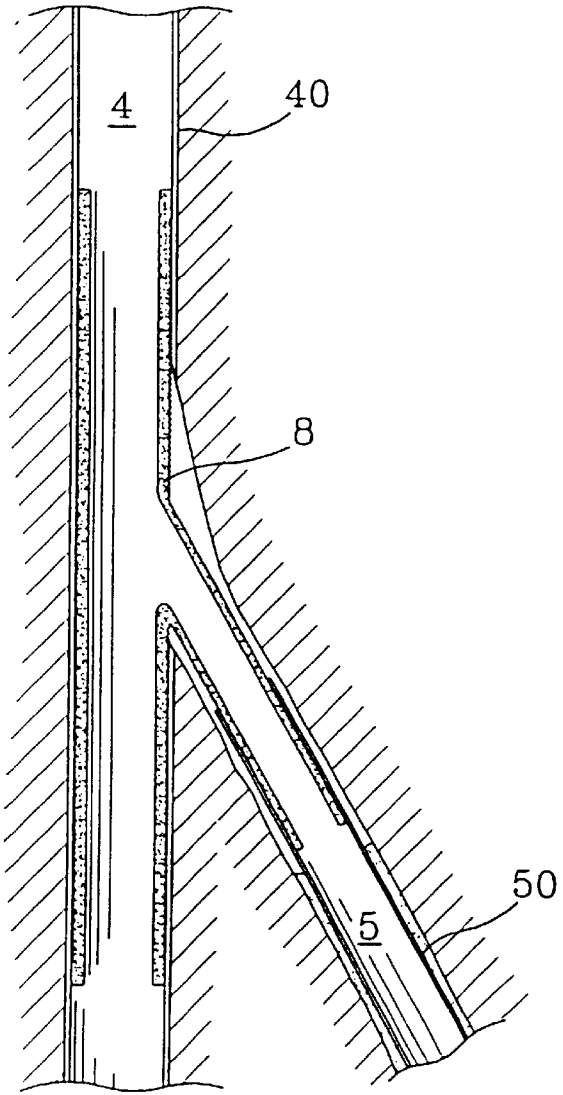

FIG. 16 shows the lining as installed.

Note that the drawings (artificially) ignore the reduction in length of the sections of the preform that results from their radial expansion and which in practise is relatively great, with a view to facilitating an understanding of the various steps of the process.

The restraining means could consist of a woven material sheath that can be torn longitudinally, from the bottom upwards, surrounding the preform parts 10*b* and 11.

The internal pressures $P_0$ and P are in fact differential pressures between the pressures inside and outside the preform.

For example, $P_0$ is less than or equal to approximately 3 bars and P is in the order of 30 bars.

Again by way of example, if the initial—unfolded but not expanded—diameter of the section 10 is in the order of 100 mm, it is in the order of 160 mm after radial expansion.

It goes without saying that the dimensions of each of the sections 10 and 11 and the value of the angle $\alpha$ are chosen to suit the actual conditions encountered in the field, in particular according to the diameter of the main and secondary bores and the angle between the two bores.

A device in which the preform consists of a main section with two or even more than two auxiliary sections is within the scope of the invention.

Similarly, the device of the invention can be used to seal and to consolidate bifurcations in pipes.

We claim:

1. A device for lining a bifurcation in a well, comprising:

a radially deformable flexible tubular preform that can be expanded by internal pressure and hardened by heating its wall to polymerize it, said preform having a rectilinear main section and a rectilinear secondary section at an acute angle to the main section and joined and sealed to the latter in a middle area;

temporary restraining means to hold the secondary section initially in a radially folded condition, pressed against the main section, the combination then constituting a rectilinear preform, wherein after removal of said temporary restraining means, and due to internal pressure, the secondary section separates from the main section, the combination then constituting a generally "y" shape preform; and an expander tool in the form of an inflatable flexible and elastic membrane bag housed inside the preform and adapted to be pulled out at the end of operation.

2. A device according to claim 1 wherein in the expanded state each section has a circular cross-section, the diameter of the main section being greater than or the same as that of the secondary section.

3. A device according to claim 1 wherein said restraining means are breakable annular bindings around the main and secondary sections adapted to break one after the other beyond a particular internal pressure threshold.

4. A device according to claim 1, wherein said well includes an oil well.

5. A device according to claim 1, wherein said device is used in a pipe.

6. A method for lining and sealing a bifurcation in a well having a main bore and an oblique secondary bore by using a preform in which the angle between a main section and a secondary section of the preform is close to that of the bifurcation, said method comprising:

a) lowering said preform into the well when in a radially retracted state and with the secondary section pressed against the main section, the combination having a rectilinear configuration;

b) positioning the preform in the area of the bifurcation so that a free end of the secondary section is at the entry of the oblique bore;

c) inflating said preform at a moderate pressure so as to rupture progressively restraining bindings and to cause progressive radial unfolding and angular deployment of the secondary section concomitantly with further lowering of the preform;

d) lowering is stopped when the bifurcate portion of the preform is substantially positioned at the level of the bifurcate portion of the well;

e) further inflating said preform by increasing its internal pressure to cause it to expand radially and to press it against the walls of the well;

f) with the increased internal pressure maintained, heating the preform to polymerize the wall;

g) deflating and separating an expander tool from the preform.

7. The method according to claim 6, wherein said well includes an oil well.

* * * * *

UNITED STATES PATENT AND TRADEMARK OFFICE

CERTIFICATE OF CORRECTION

PATENT NO. : 5,964,288
DATED : October 12, 1999
INVENTOR(S) : Leighton et al.

It is certified that error appears in the above-identified patent and that said Letters Patent is hereby corrected as shown below:

Item [57], Abstract,
Line 3, please delete "hardened in situ" and insert -- hardened in situ --.

Item [57], Abstract,
Please delete the first occurrence "temporary restraining bindings" and insert -- temporary restraining means --.
Please delete the second occurrence "temporary restraining bindings" and insert -- temporary restraining means --.

Signed and Sealed this

Fourteenth Day of August, 2001

*Attest:*

Nicholas P. Godici

*Attesting Officer*

NICHOLAS P. GODICI
*Acting Director of the United States Patent and Trademark Office*